US008247984B2

(12) United States Patent
Ren et al.

(10) Patent No.: US 8,247,984 B2
(45) Date of Patent: Aug. 21, 2012

(54) LED CIRCUIT AND METHOD FOR CONTROLLING THE AVERAGE CURRENT OF THE LED

(75) Inventors: Yuancheng Ren, Hangzhou (CN); Lei Du, Hangzhou (CN); Yong Huang, Tokyo (JP)

(73) Assignee: Monolithic Power Systems, Inc., San Jose, CA (US)

( * ) Notice: Subject to any disclaimer, the term of this patent is extended or adjusted under 35 U.S.C. 154(b) by 373 days.

(21) Appl. No.: 12/755,341

(22) Filed: Apr. 6, 2010

(65) Prior Publication Data

US 2010/0259180 A1 Oct. 14, 2010

(30) Foreign Application Priority Data

Apr. 10, 2009 (CN) ..... 2009 1 0058905

(51) Int. Cl.
*H05B 37/02* (2006.01)

(52) U.S. Cl. ..... 315/224; 315/291; 315/307

(58) Field of Classification Search ..... 315/224, 315/291, 294, 307–311, 312
See application file for complete search history.

(56) References Cited

U.S. PATENT DOCUMENTS

| | | | | |
|---|---|---|---|---|
| 7,295,176 | B2 * | 11/2007 | Yang | 345/82 |
| 7,579,818 | B2 * | 8/2009 | Ball et al. | 323/284 |
| 7,898,187 | B1 * | 3/2011 | Mei et al. | 315/247 |
| 8,129,916 | B2 * | 3/2012 | Godbole | 315/225 |
| 2006/0170373 | A1 * | 8/2006 | Yang | 315/209 R |
| 2009/0284178 | A1 * | 11/2009 | Jessenig et al. | 315/297 |
| 2010/0123411 | A1 * | 5/2010 | Godbole et al. | 315/291 |
| 2011/0069960 | A1 * | 3/2011 | Knapp et al. | 398/103 |
| 2011/0089859 | A1 * | 4/2011 | Tseng et al. | 315/294 |

* cited by examiner

*Primary Examiner* — Don Le
(74) *Attorney, Agent, or Firm* — Perkins Coie LLP

(57) ABSTRACT

An LED circuit is disclosed. The circuit senses the average current flowing through the LED. The sensed signal is compensated and modulated. The modulated signal is then used to control the ON/OFF state of a switch that supplies power to the LED.

15 Claims, 11 Drawing Sheets

LED CIRCUIT AND METHOD FOR CONTROLLING THE AVERAGE CURRENT OF THE LED

CROSS-REFERENCE TO RELATED APPLICATIONS

This application claims priority to and the benefit of Chinese Patent Application No. 200910058905.3, filed Apr. 10, 2009, which is incorporated herein by reference in its entirety.

TECHNICAL FIELD

The technology described in this patent document relates generally to integrated circuits, and more particularly, to LED circuits.

BACKGROUND

LED is rapidly replacing incandescent bulbs, fluorescent lamps, and other types of light sources due to its high efficiency, small size, high reliability, and long lifetime. FIG. 1 is a typical application of an LED used in a buck converter. As shown in FIG. 1, when a switch $S_1$ is turned on, a switch $S_2$ is turned off, an input $V_{IN}$, an inductor L, the LED, and the switch $S_1$ form a current loop. The current flowing through the inductor L and the LED increases. When the switch $S_1$ is turned off, the switch $S_2$ is turned on, the inductor L, the LED, and the switch $S_2$ form a current loop. The current flowing through the inductor L and the LED decreases. The switch $S_2$ is usually replaced by a freewheeling diode in use. The switch $S_1$ is put in the low side as shown, so that no floating drive circuit is needed.

The brightness of the LED is determined by the average current that flows. As a result, accurately controlling the average current of the LED is important. There are two current control methods which are adopted by conventional buck type LED circuits. Method 1 senses the current flowing through the low-side switch. This current sensing could be realized by the switch's own conductive resistance. Then the current is regulated by peak current mode control. This current control method is simple, with no external circuit or pin needed. In the peak current mode control, the peak value of the current is accurately controlled. However, because of the influence caused by the ripple, the error of the average current is large, which causes low precision.

Method 2 adopts a current sense resistor coupled in series with the LED. The current flowing through the LED is detected by the current sense resistor. Then the current is regulated by the average current mode control. This current control method has high precision. However, the series coupled current sense resistor introduces additional power loss.

DETAILED DESCRIPTION

Figure 1:
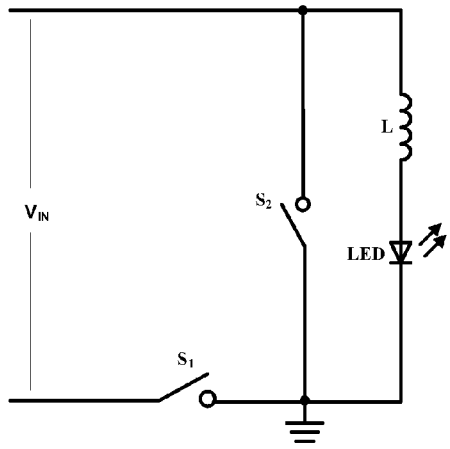
FIG. 1 illustrates a typical application of LED used in a buck type converter.
Figure 2:
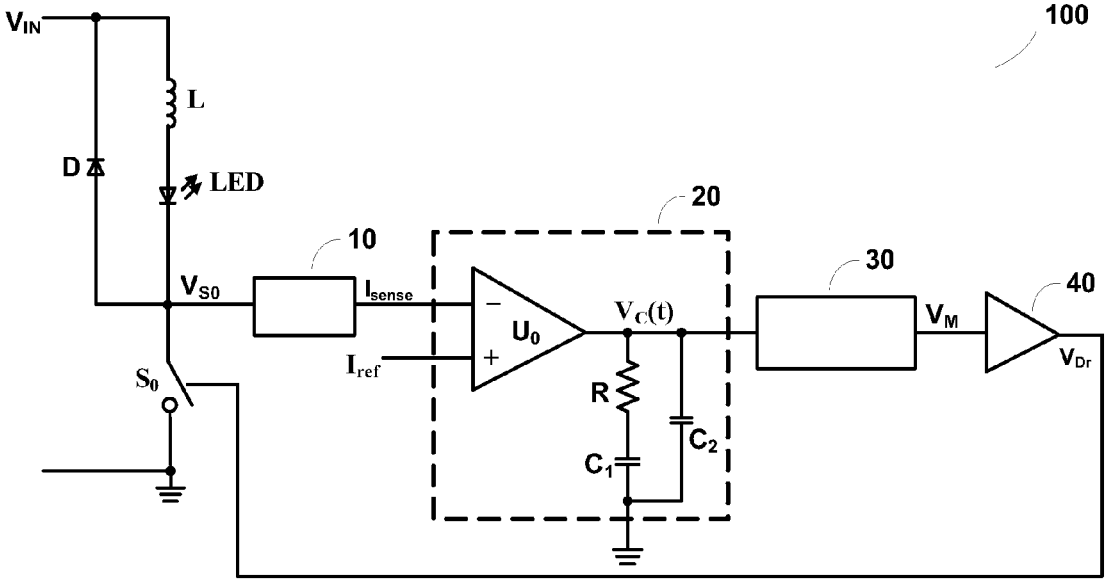
FIG. 2 illustrates a circuit 100 which accurately control the average current of the LED in accordance with an embodiment of the present invention.

Referring to FIG. 2, a circuit 100 which accurately controls the average current of the LED in accordance with an embodiment of the present invention is shown. As shown in FIG. 2, circuit 100 comprises a typical buck converter comprised by an input port $V_{IN}$, a main switch $S_0$, a freewheeling diode D, an inductor L and a LED. That is, the LED is coupled in series with the inductor L, the series coupled LED and the inductor L are coupled in parallel with the freewheeling diode D which is coupled between the input port $V_{IN}$ and ground via the main switch $S_0$. Circuit 100 further comprises a sense unit 10, a compensation unit 20, a modulate unit 30 and a drive circuit 40. The input terminal of the sense unit 10 is coupled to the high terminal of the main switch $S_0$, the output terminal of the sense unit 10 is coupled to one input terminal of the compensation unit 20. The other input terminal of the compensation unit 20 receives a reference signal $I_{ref}$. The output terminal of the compensation unit 20 is coupled to the modulate unit 30. The modulate unit 30 provides a modulated signal $V_M$ which is delivered to the control terminal of the main switch $S_0$ via the drive circuit 40, so as to control the ON/OFF of the main switch $S_0$.

In one embodiment, the compensation unit 20 includes an operational amplifier $U_0$ and a RC filter. The RC filter comprises a resistor R, a capacitor $C_1$, and a capacitor $C_2$. The inverting input terminal of the operational amplifier $U_0$ acts as one input terminal of the compensation unit 20, which receives the sense signal $I_{sense}$ provided by the sense unit 10. The non-inverting input terminal of the operation amplifier $U_0$ acts as the other input terminal of the compensation unit 20 which receives the reference $I_{ref}$. The resistor R and the capacitor $C_1$ are coupled in series between the output terminal of the operation amplifier $U_0$ and ground. The capacitor $C_2$ is coupled between the output terminal of the operation amplifier $U_0$ and ground. When the circuit 100 is in operation, the operation amplifier $U_0$ amplifies the difference between the sense signal $I_{sense}$ and the reference signal $I_{ref}$, and integrates the amplified signal into the capacitor $C_2$. In other words, a compensated signal $V_C(t)$ provided by the operation amplifier $U_0$ represents the amplified signal. If the sense signal $I_{sense}$ is higher than the reference signal $I_{ref}$, the compensated signal $V_C(t)$ decreases; if the sense signal $I_{sense}$ is lower than the reference signal $I_{ref}$, the compensated signal $V_C(t)$ increases; if the sense signal $I_{sense}$ is equal to the reference signal $I_{ref}$, the compensated signal $V_C(t)$ is held. As a result, the compensation unit 20 regulates the signal at the inverting input terminal of the operation amplifier $U_0$ to follow the reference signal.

When the main switch $S_0$ is turned on, the current flowing through the main switch $S_0$ is the current flowing through the LED. The sense unit 10 receives the voltage $V_{S0}$ across the main switch $S_0$, and provides the sense signal $I_{sense}$ to the non-inverting input terminal of the operation amplifier $U_0$. The voltage $V_{S0}$ is the product of the current $I_{S0}$ flowing through the main switch $S_0$ and its conduct resistance. The difference of the sense signal $I_{sense}$ and the reference signal $I_{ref}$ is amplified by the operation amplifier $U_0$; the amplified signal is filtered by the RC filter to get the compensated signal $V_C(t)$. Then the compensated signal $V_C(t)$ is modulated in the modulate unit 30. The modulated signal $V_M$ is used to drive the main switch $S_0$ via the drive circuit 40. The operation of the sense unit 10 and the modulate unit 30 will be illustrated hereinafter.

Figure 3:
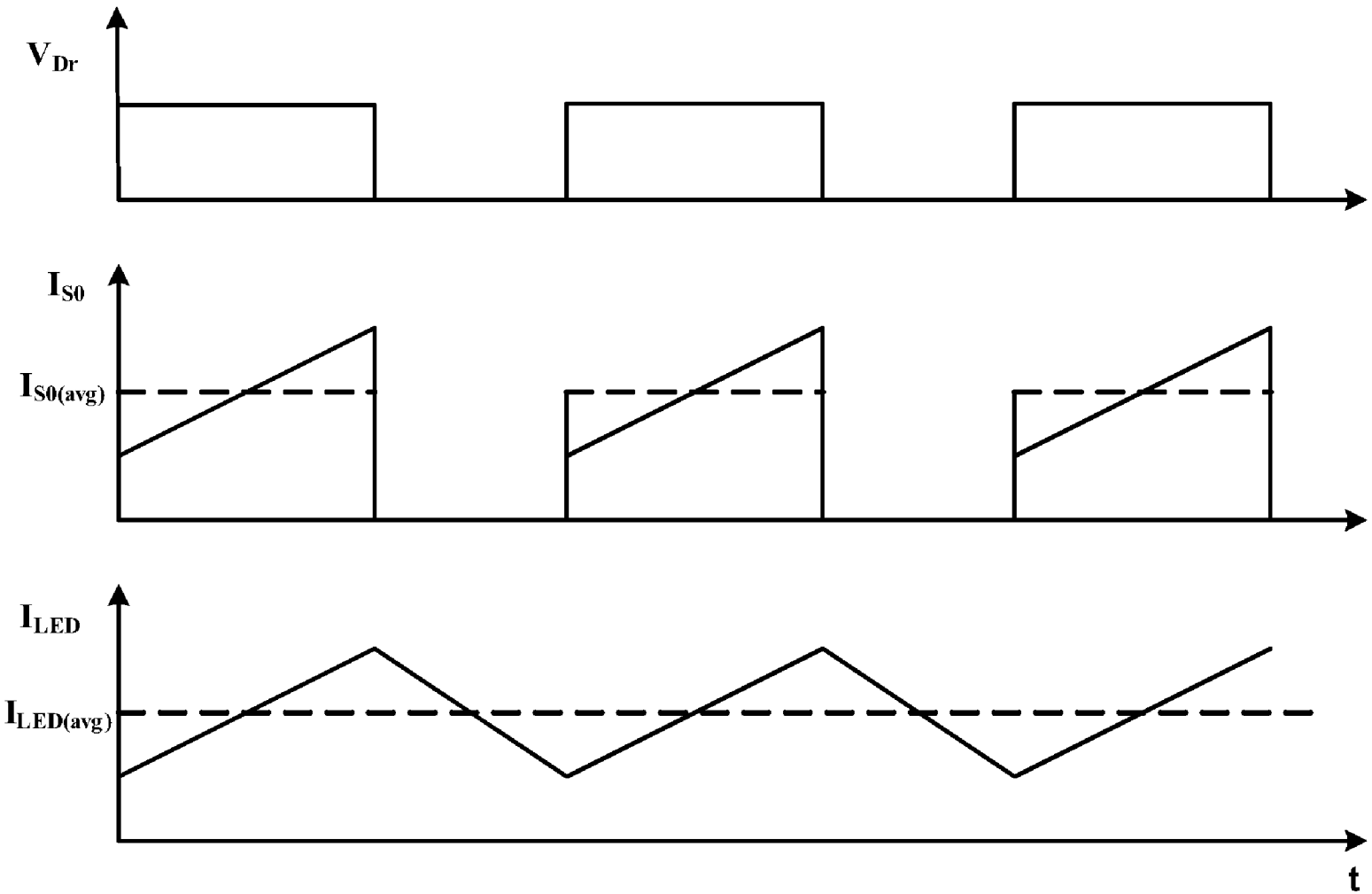
FIG. 3 illustrates waveforms of the drive signal of a main switch, the current flowing through the main switch, and the current flowing through the LED of circuit 100 of FIG. 2.

When the main switch $S_0$ is turned on, the current flowing through the main switch $S_0$ is the current flowing through the LED. So the average current $I_{S0(avg)}$ of the main switch $S_0$ is equal to the average current $I_{LED(avg)}$ of the LED during the ON period of the main switch $S_0$, as shown in FIG. 3. As a result, the average current of the LED could be regulated by regulating the average current of the main switch $S_0$ during its ON period.

Two current sense methods are disclosed as follows.

Figure 4:
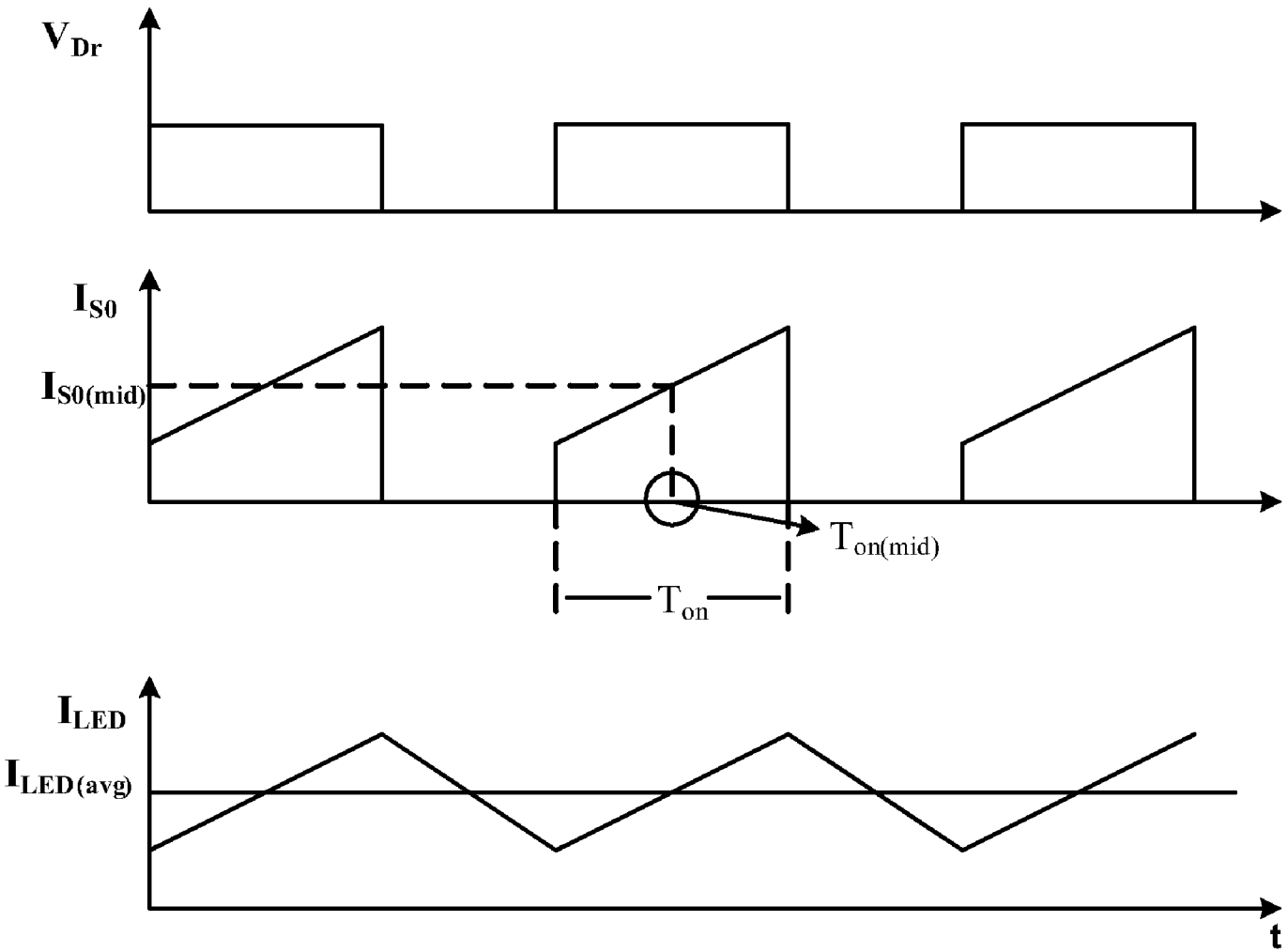
FIG. 4 illustrates the principle of a mid-current sense method.

Method 1 is defined as mid-current sense, whose principle is shown in FIG. 4. The current $I_{S0}$ flowing through the main switch $S_0$ is the current $I_{LED}$ flowing through the LED during the ON period of the main switch $S_0$. For illustration purpose, the current at the mid time point of the main switch $S_0$'s ON time is referred to as mid-current $I_{S0(mid)}$. As shown in FIG. 4, the mid-current $I_{S0(mid)}$ is equal to the average current $I_{S0(avg)}$ of the main switch during its ON period. Thus $I_{S0(mid)}=I_{S0(avg)}=I_{LED(avg)}$. Accordingly, if the mid-current $I_{S0(mid)}$ is sensed and held, the average current of the LED is sensed, which is further regulated by the compensation unit 20 and the modulate unit 30.

Figure 5:
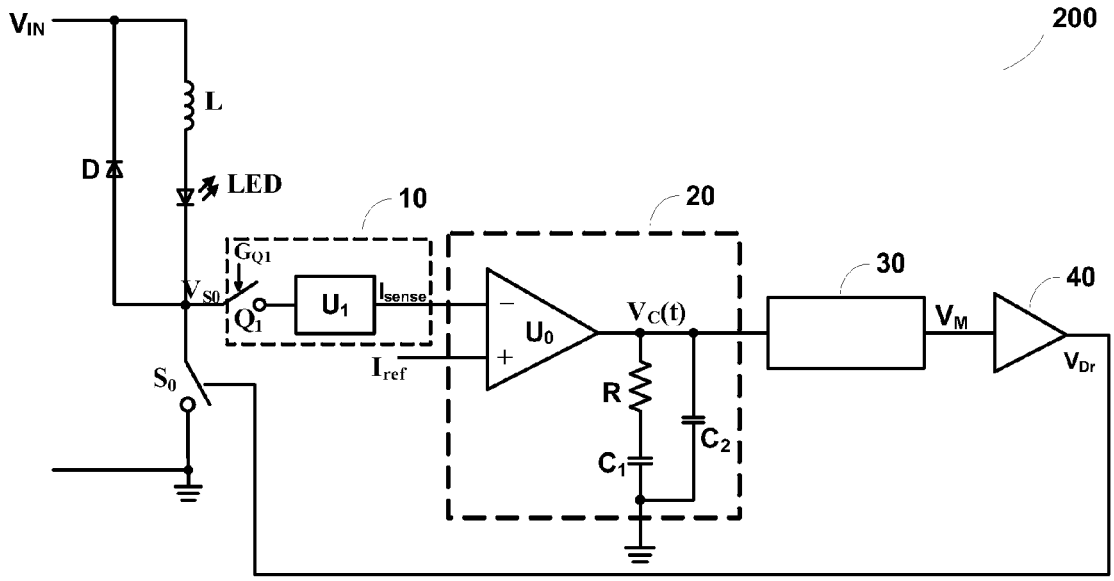
FIG. 5 illustrates a circuit 200 which realizes the mid-current sense method of FIG. 4 in accordance with an embodiment of the present invention.

Referring to FIG. 5, a circuit 200 which realizes the mid-current sense method of FIG. 4 is illustrated. In one embodiment, the sense unit 10 comprises a first switch $Q_1$ and a hold circuit $U_1$ coupled in series. The sense unit 10 delivers the sense signal $I_{sense}$ to the compensation unit 20, so as to insure that the sense signal $I_{sense}$ follows the reference signal $I_{ref}$. The control signal $G_{Q1}$ of the first switch $Q_1$ is generated by a pulse signal generating circuit 50 shown in FIG. 6. The pulse signal generating circuit 50 comprises a first delay circuit $T_{delay1}$ and a second delay circuit $T_{delay2}$, both of which receive the drive signal $V_{Dr}$ provided by the drive circuit 40. The first delay circuit $T_{delay1}$ provides a first delay signal ① to the first inverter $U_2$ to get a delay-invert signal ②. The delay-invert signal ② is delivered to one input terminal of the AND gate $U_3$. The second delay circuit $T_{delay2}$ provides a second delay signal ③ to the other input terminal of the AND gate U3. The output signal of the AND gate $U_3$ is the desired control signal $G_{Q1}$ of the first switch $Q_1$ in the sense unit 10 of FIG. 5. The delay time of the first delay circuit $T_{delayl}$ is $$\frac{T_{ON}}{2},$$

and the second delay circuit $T_{delay2}$ is $$\frac{T_{ON}}{2}-T_1,$$

wherein $T_{ON}$ is the ON time period of the main switch $S_0$ in one cycle, i.e., the duration of the high level of the drive signal $V_{Dr}$.

Figure 6:
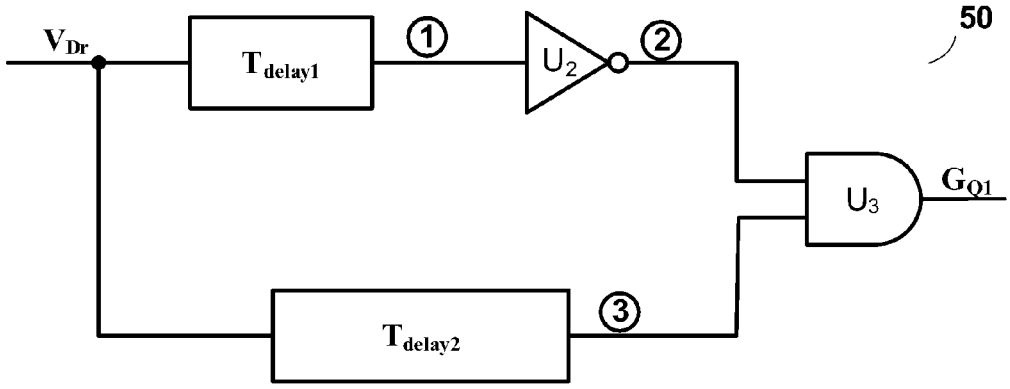
FIG. 6 illustrates a pulse signal generating circuit 50.
Figure 7:
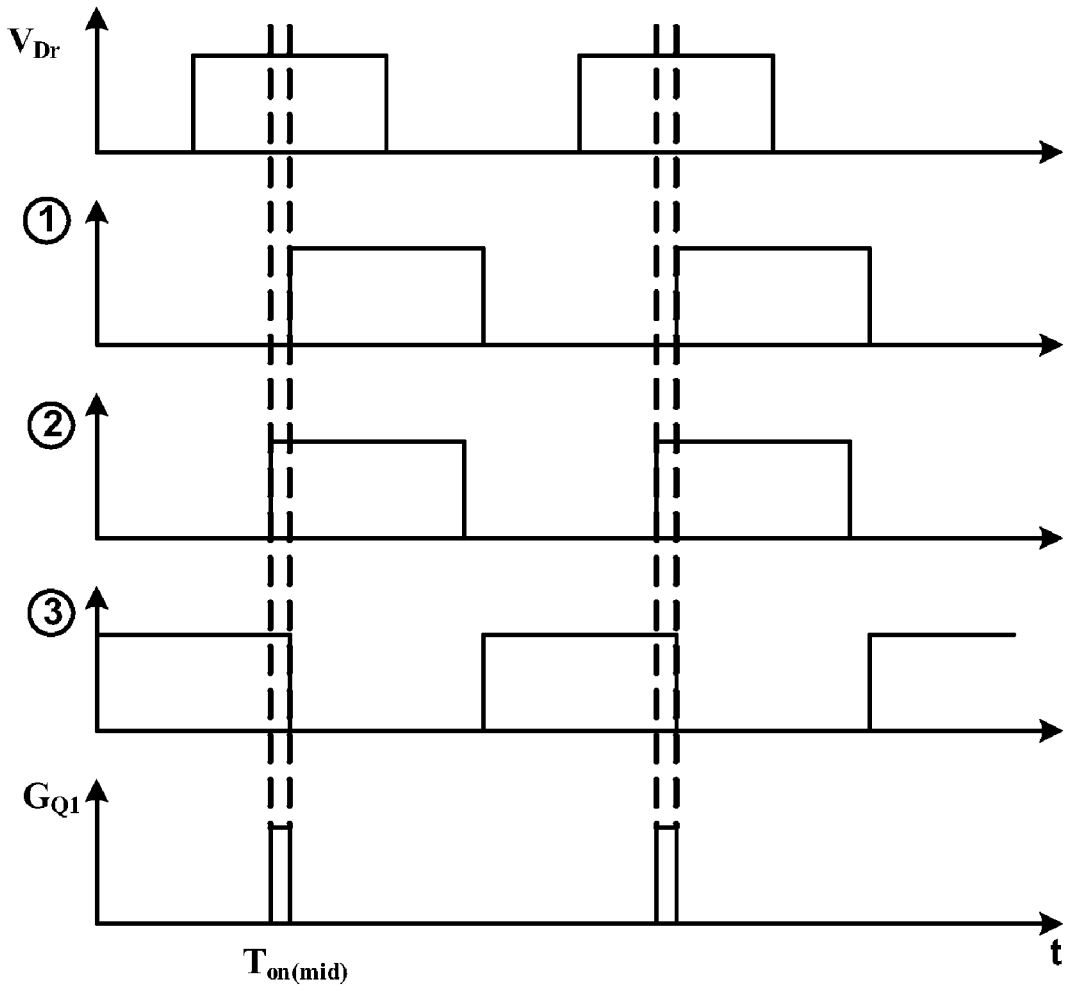
FIG. 7 illustrates waveforms of signals ①, ②, ③, and $G_{Q1}$ generated by the pulse generating circuit 50 of FIG. 6.

FIG. 7 illustrates waveforms of signals ①, ②, ③, and $G_{Q1}$ generated by the pulse generating circuit 50 of FIG. 6. As shown in FIG. 7, the control signal $G_{Q1}$ is a pulse signal. In order to insure the error caused by the mid-current $I_{S0(mid)}$ to be lower than a certain K, the pulse width of the $T_{ON(mid)}$ should be lower than $K^{1/2}\times T_{ON}$, wherein K is a desired precision. In one embodiment, $T_1$ in the delay time of the second delay circuit $T_{delay2}$ is a time constant, which is set for the system precision.

Figure 8:
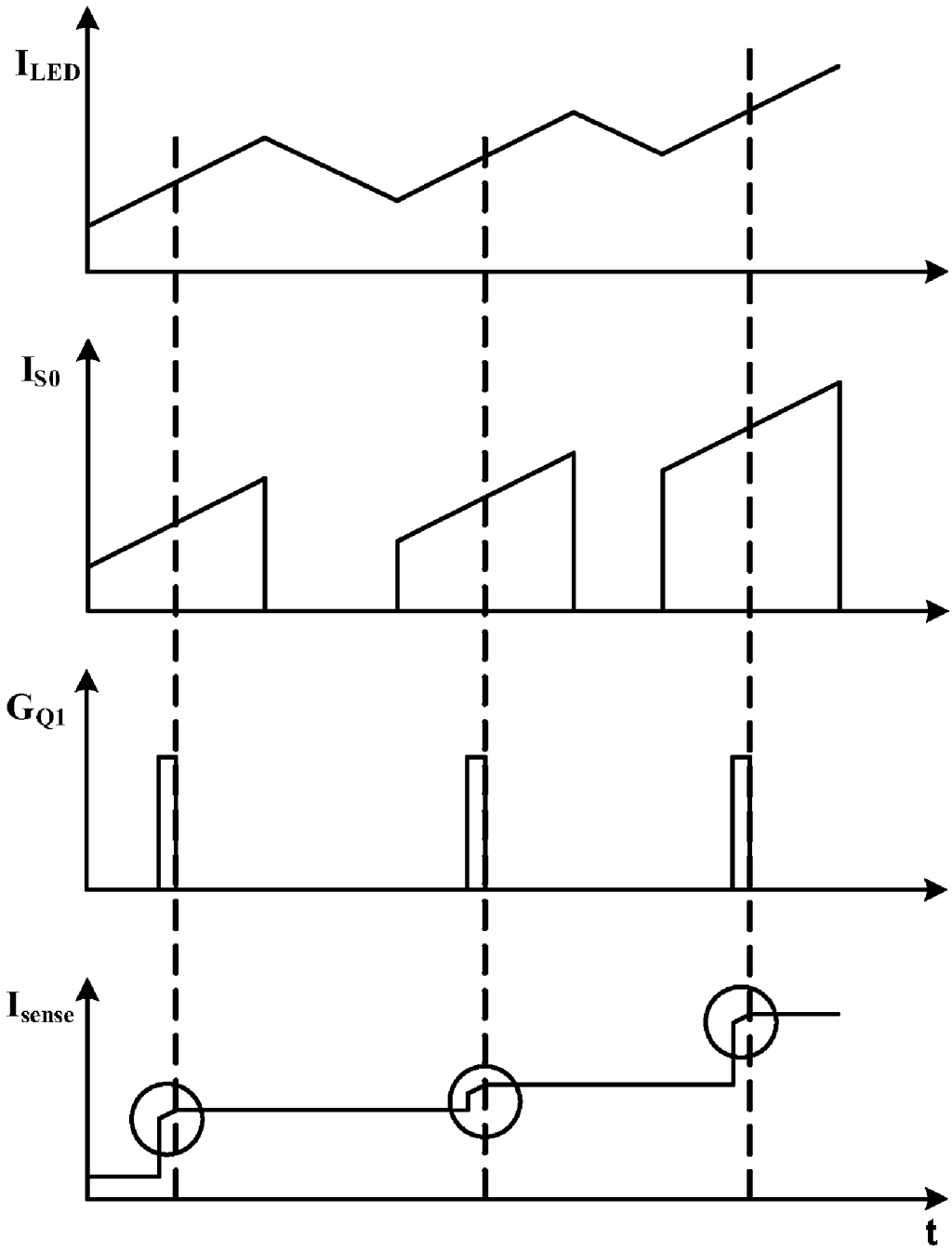
FIG. 8 illustrates waveforms of the current $I_{LEA}$ flowing through the LED, the current $I_{S0}$ flowing through the main switch current, the control signal of the first switch $G_{Q1}$, and the sense signal $I_{sense}$ of circuit 100 of FIG. 5.

Referring to FIG. 8, the waveforms of circuit 100 of FIG. 5 is shown. As shown in FIG. 8, the sense signal $I_{sense}$ varies with the current flowing through the LED, wherein the cycle of the sense signal $I_{sense}$ starts from the mid time point of the main switch $S_0$'s ON time, ends at the mid time point of the main switch S0's next ON time. As illustrated hereinbefore, the average current of the LED is accurately sensed by the mid-current sense method.

Figure 9:
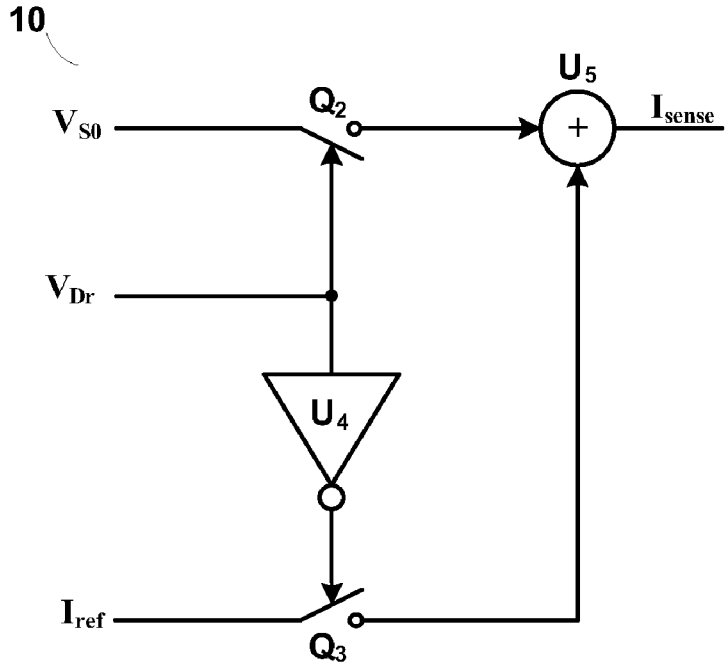
FIG. 9 illustrates a sense unit 10 which realizes the full-wave sense.

Method 2 is defined as full-wave sense. The corresponding circuit of the sense unit 10 is shown in FIG. 9. As shown in FIG. 9, the sense unit 10 comprises a second switch $Q_2$ which receives a voltage signal $V_{S0}$ across the main switch $S_0$; a third switch $Q_3$ which receives the reference signal $I_{ref}$. Because the voltage signal $V_{S0}$ is the product of the current $I_{S0}$ flowing through the main switch $S_0$ and its conduct resistance, the voltage signal $V_{S0}$ represents the current $I_{S0}$. The second switch $Q_2$ is controlled by the drive signal $V_{Dr}$ which also controls the ON/OFF of the main switch $S_0$, i.e., the second switch $Q_2$ is synchronized with the main switch $S_0$; the third switch $Q_3$ is controlled by the inverted signal of the drive signal $V_{Dr}$. That is, a first terminal of the second switch $Q_2$ is coupled to the high terminal of the main switch $S_0$, the control terminal of the second switch $Q_2$ is coupled to the control terminal of the main switch $S_0$; a first terminal of the third switch $Q_3$ receives the reference signal $I_{ref}$, the control terminal of the third switch $Q_3$ is coupled to the control terminal of the main switch $S_0$ via a second inverter $U_4$.

A second terminal of the second switch $Q_2$ is coupled to a first terminal of a first adder $U_5$, a second terminal of the third switch $Q_3$ is coupled to a second input terminal of the first adder $U_5$. The output signal of the first adder $U_5$ is the desired sense signal $I_{sense}$. The operation of the sense unit 10 is illustrated in detail as follows.

Figure 10:
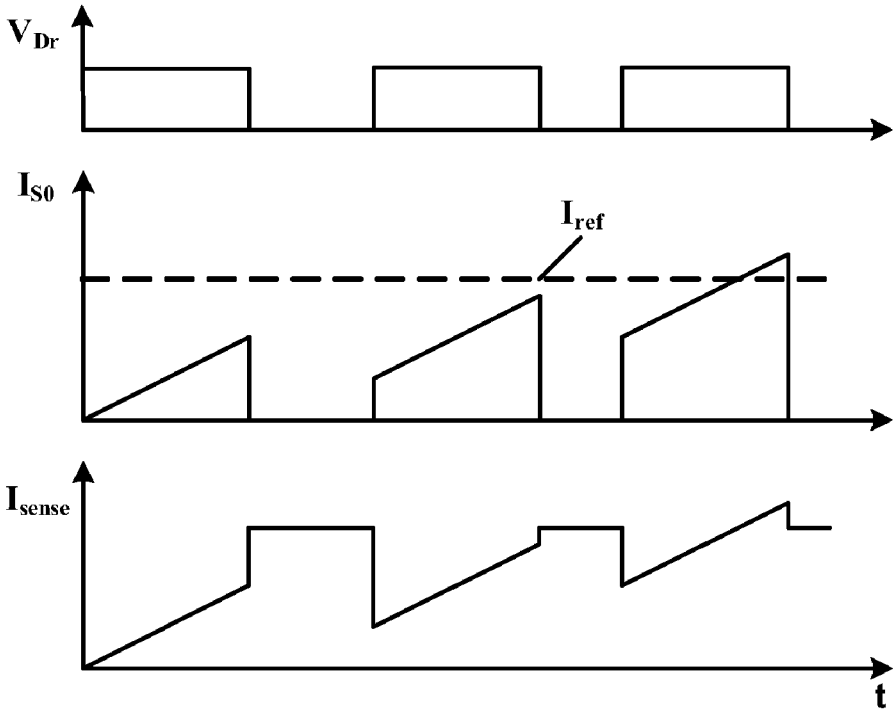
FIG. 10 illustrates waveforms of the drive signal $V_{Dr}$, the current $I_{S0}$ flowing through the main switch current, and the sense signal $I_{sense}$ of the sense circuit 10 of FIG. 9.

When the main switch $S_0$ is turned on, the second switch $Q_2$ is turned on as well, the third switch $Q_3$ is turned off. The second switch $Q_2$ delivers the current signal $I_{S0}$ to the first adder $U_5$, the third switch $Q_3$ disconnects the reference signal $I_{ref}$ to the first adder $U_5$. Accordingly, the sense signal $I_{sense}$ is the current signal $I_{S0}$. When the main switch $S_0$ is turned off, the second switch $Q_2$ is turned off, the third switch $Q_3$ is turned on. As a result, the second switch $Q_2$ disconnects the current signal $I_{S0}$ to the first adder $U_5$, the third switch $Q_3$ delivers the reference signal $I_{ref}$ to the first adder U5. Accordingly, the sense signal $I_{sense}$ is the reference signal $I_{ref}$. Waveforms of the drive signal $V_{Dr}$, the current $I_{S0}$ flowing through the main switch $S_0$, and the sense signal $I_{sense}$ are shown in FIG. 10. For the existence of the compensation circuit 20, the sense signal $I_{sense}$ follows the reference signal $I_{ref}$. In addition, the sense signal $I_{sense}$ is equal to the reference signal $I_{ref}$ during the main switch $S_0$'s OFF time. This full-wave sense method insures the average current of the main switch $S_0$ to be equal to the reference signal during the ON period of the main switch $S_0$, i.e., insures the average current of the LED to be equal to the reference signal.

Figure 11:
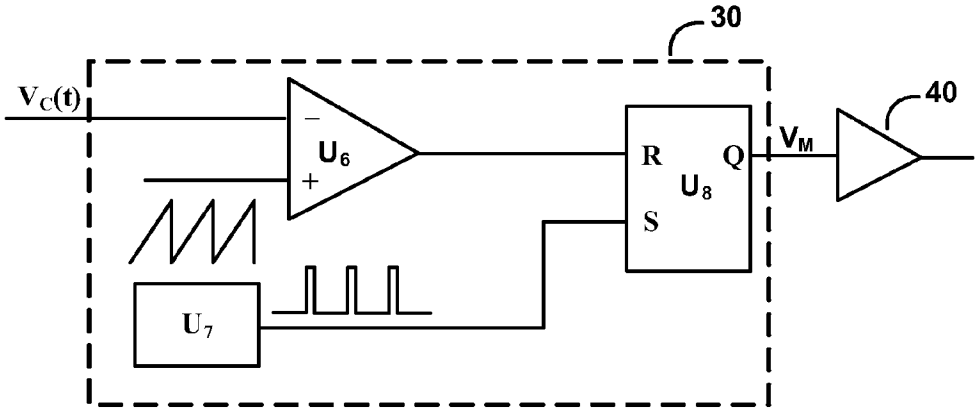
FIG. 11 illustrates a modulate unit 30 in accordance with an embodiment of the present invention.

The average current $I_{S0(avg)}$ could be accurately modulated via the modulator 30 based on the sense signal provided by the mid-current sense method and the full-wave sense method. Referring to FIG. 11, a modulate unit 30 in accordance with an embodiment of the present invention is illustrated. As shown in FIG. 11, the modulate unit 30 is a well-known PWM modulator. The modulate unit 30 comprises a comparator $U_6$, a clock signal generator $U_7$, a RS flip-flop $U_8$. The inverting input terminal of the comparator $U_6$ receives the compensated signal $V_C(t)$, the non-inverting input terminal of the comparator $U_6$ receives a saw-tooth signal provided by the clock signal generator $U_7$, the output terminal of the comparator $U_6$ is coupled to a reset terminal R of the RS flip-flop $U_8$. The clock signal provided by the clock signal generator $U_7$ is delivered to a set terminal S of the RS flip-flop $U_8$. The output signal Q of the RS flip-flop $U_8$ is the desired modulated signal $V_M$. The modulated signal $V_M$ is used to drive the main switch $S_0$ via the drive circuit 40.

On one hand, when the rising edge of the clock signal arrives, the RS flip-flop $U_8$ is reset, so the modulated signal $V_M$ goes high, and the main switch $S_0$ is turned on via the drive circuit 40. The current $I_{S0}$ flowing through the main switch $S_0$ increases, i.e., the current $I_{LED}$ flowing through the LED increases. As a result, the sense signal $I_{sense}$ increases, which causes the compensated signal $V_C(t)$ to decrease. On the other hand, the saw-tooth signal slowly increases. When it increases to be higher than the compensated signal $V_C(t)$, the output of the comparator $U_6$ turns to high, which resets the RS flip-flop $U_8$. Then the main switch $S_0$ is turned off via the drive circuit 40.

If the average current $I_{LED(avg)}$ of the LED is higher than the reference signal $I_{ref}$, the compensated signal $V_C(t)$ is relatively low. Accordingly, the saw-tooth signal touches the compensated signal $V_C(t)$ earlier, which resets the RS flip-flop $U_8$ earlier, causing the ON time of the main switch to be shorter. As a result, the average current $I_{LED(avg)}$ of the LED decreases. If the average current $I_{LED(avg)}$ of the LED is lower than the reference signal $I_{ref}$, the compensated signal $V_C(t)$ is relatively high. Accordingly, the saw-tooth signal touches the compensated signal $V_C(t)$ later, which resets the RS flip-flop $U_8$ later, causing the ON time of the main switch to be longer. As a result, the average current $I_{LED(avg)}$ of the LED increases.

Through such regulation of the modulate unit 30, the average current $I_{LED(avg)}$ of the LED is accurately controlled.

Figure 12:
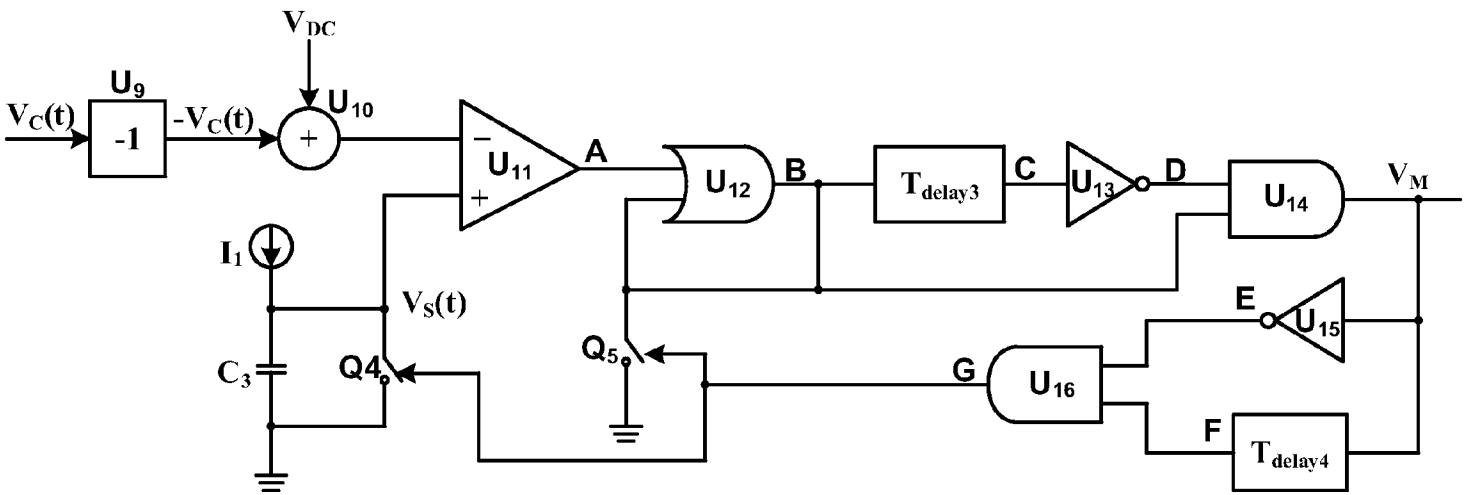
FIG. 12 illustrates a modulate unit 30 in accordance with another embodiment of the present invention.

Referring to FIG. 12, a modulate unit 30 in accordance with another embodiment of the present invention is illustrated. In one embodiment, the modulate unit 30 is a constant on-time modulation circuit. The constant on-time modulation keeps ON time of a switch to be constant in each cycle, but varies the switch frequency.

As shown in FIG. 12, the modulate unit 30 comprises a multiplier Ug whose coefficient is −1, i.e., the output of the multiplier $U_9$ is $-V_C(t)$, which is delivered to a first input terminal of a second adder $U_{10}$. A second input terminal of the second adder $U_{10}$ receives a DC offset $V_{DC}$. The DC offset $V_{DC}$ is set to insure that the output signal $(V_{DC}-V_C(t))$ of the adder $U_{10}$ is above zero all the time. The signal $(V_{DC}-V_C(t))$ is sent to the inverting input terminal of the comparator $U_{11}$, while the non-inverting input terminal of the comparator $U_{11}$ receives a saw-tooth signal $V_S(t)$. The saw-tooth signal $V_S(t)$ is generated by a saw-tooth signal generator which comprises a current source $I_1$, a capacitor $C_3$, and a fourth switch $Q_4$. The output signal A of the comparator $U_{11}$ is sent to a first input terminal of an OR gate $U_{12}$. A second input terminal of the OR gate $U_{12}$ is coupled to ground via a fifth switch $Q_5$. The second input terminal of the OR gate $U_{12}$ is also coupled to its output terminal which is further coupled to an input terminal of a third delay circuit $T_{delay3}$ and a first input terminal of an AND gate $U_{14}$. The third delay circuit $T_{delay3}$ provides an output signal C which is delivered to an inverter $U_{13}$, to get an inverted signal D which is sent to a second input terminal of the AND gate $U_{14}$. The output signal $V_M$ of the AND gate $U_{14}$ is the desired modulated signal, which is sent to the drive circuit 40. The modulated signal $V_M$ is further sent to a fourth inverter $U_{15}$ to get a signal E, and is sent to a fourth delay circuit $T_{delay4}$ to get a signal F. The signal E and the signal F are sent to an AND gate $U_{16}$ to get a AND signal G which is used to control the ON/OFF of the fourth switch $Q_4$ and the fifth switch $Q_5$.

When the saw-tooth signal $V_S(t)$ touches the level of the signal $(V_{DC}-V_C(t))$, the output signal A of the comparator $U_{11}$ goes high. The signal B goes high as well. Accordingly, the modulated signal $V_M$ is determined by the signal D at the second input terminal of the AND gate $U_{14}$. Because the effect of the third delay circuit $T_{delay3}$, the signal C goes high later than the signal B a time period of $T_{d3}$. The signal D is an inverted signal of the signal C. Thus from the time point the signal B goes high, to the time point the delay time period $T_{d3}$ ends, the modulated signal $V_M$ is high. That is, the modulated signal $V_M$ retains high for a time period of $T_{d3}$. The constant on-time $T_{ON}$ is determined by the delay time $T_{d3}$ of the third delay circuit $T_{delay3}$.

The delay time $T_{d4}$ of the fourth delay circuit $T_{delay4}$ is relatively short, which could be regarded as a short pulse time period. When the modulated signal $V_M$ turns to low after the time period $T_{d3}$, the signal E turns to high. However, the signal F turns to high later than the signal E a time period of $T_{d4}$. As a result, the signal G is a short pulse. The fourth switch $Q_4$ and the fifth switch $Q_5$ are turned on during this short pulse time period. And the saw-tooth signal $V_S(t)$ is reset to zero, the output signal A of the comparator $U_{11}$ turns to low. In the meantime, signal B is pulled to ground. After the short pulse time period $T_{d4}$, the saw-tooth signal $V_S(t)$ increases from zero, and the signal B keeps low until the saw-tooth signal $V_S(t)$ touches the level of the signal $(V_{DC}-V_C(t))$ again. Then the signal A turns to high, a new cycle begins.

If the average current $I_{LED(avg)}$ is higher than the reference signal $I_{ref}$, the compensated signal $V_C(t)$ decreases, which causes $(V_{DC}-V_C(t))$ to increase. Accordingly, the saw-tooth signal $V_S(t)$ touches the signal $(V_{DC}-V_C(t))$ later, and the low-level time of the signal A becomes longer, so as the signal B and the compensated signal $V_M$. On the other hand, if the average current $I_{LED(avg)}$ is lower than the reference signal $I_{ref}$, the compensated signal $V_C(t)$ increases, which causes $(V_{DC}-V_C(t))$ to decrease. Accordingly, the saw-tooth signal $V_S(t)$ touches the signal $(V_{DC}-V_C(t))$ earlier, and the low-level time of the signal A becomes shorter, so as the signal B and the compensated signal $V_M$.

From the above illustration, the modulated signal $V_M$ is the desired modulation signal whose high-level time period is constant while low-level time period is varied according to the average current $I_{LED(avg)}$ of the LED. So the average current $I_{LED(avg)}$ could be accurately controlled by such regulation.

Figure 13:
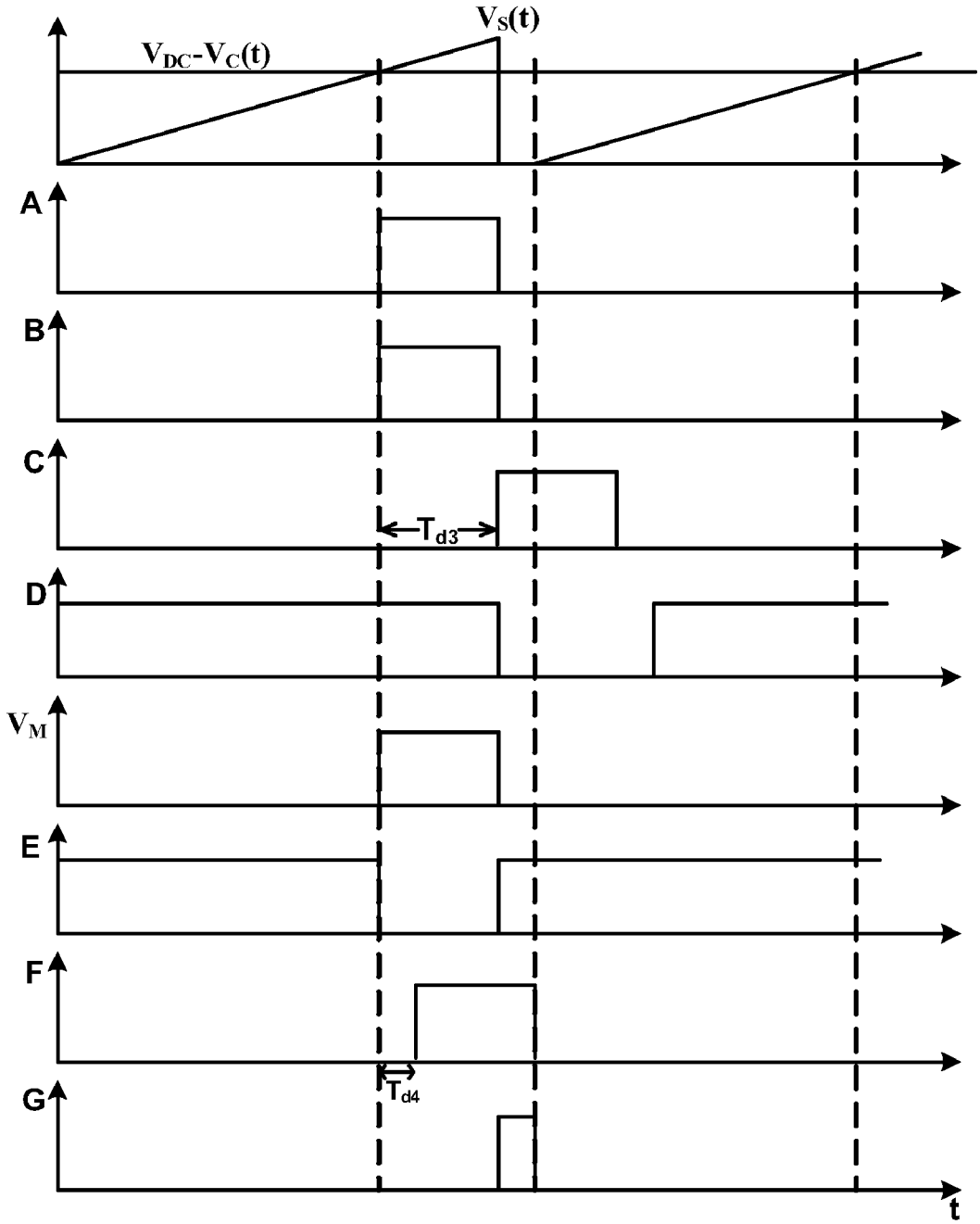
FIG. 13 illustrates waveforms of signals A, B, C, D, E, F, G, and the compensated signal $V_M$ of FIG. 12.

FIG. 13 illustrates waveforms of signals A, B, C, D, E, F, G, and the compensated signal $V_M$ of FIG. 12.

Figure 14:
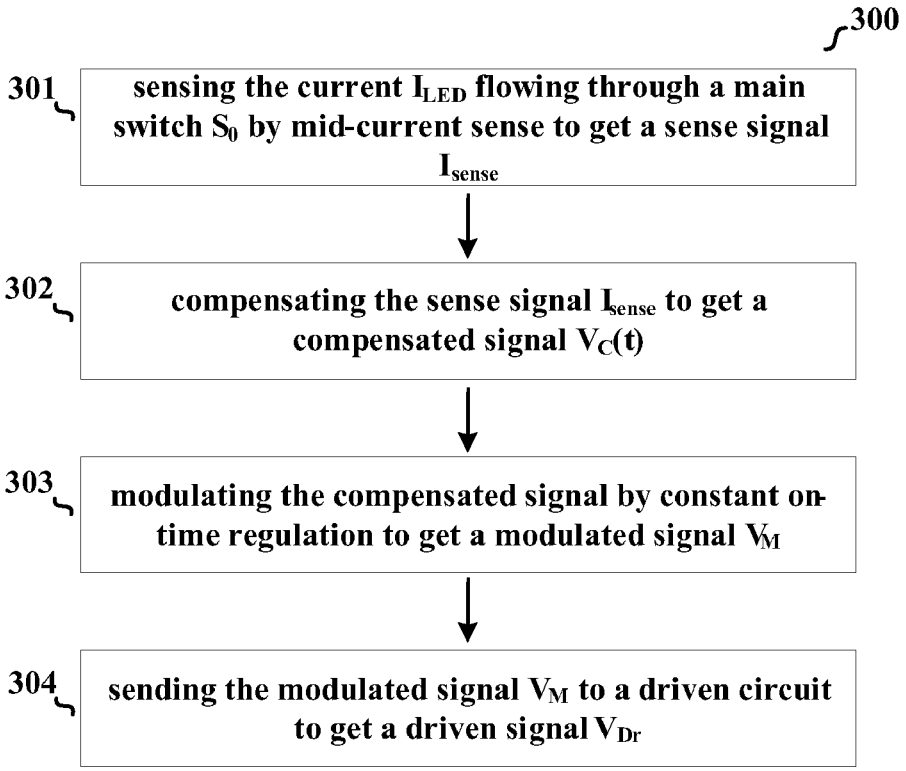
FIG. 14 illustrates a method 300 controlling the average current of the LED in accordance with yet another embodiment of the present invention.

Referring to FIG. 14, a method 300 controlling the average current of the LED in accordance with yet another embodiment of the present invention is illustrated. The method 300 comprises the following steps: step 301, sensing the current $I_{LED}$ flowing through a main switch $S_0$ by mid-current sense to get a sense signal $I_{sense}$; step 302, compensating the sense signal $I_{sense}$ to get a compensated signal $V_C(t)$; step 303, modulating the compensated signal $V_C(t)$ by constant on-time regulation to get a modulated signal $V_M$; step 304, sending the modulated signal $V_M$ to a drive circuit to get a drive signal $V_{Dr}$ which is used to control the ON/OFF of the main switch $S_0$.

Figure 15:
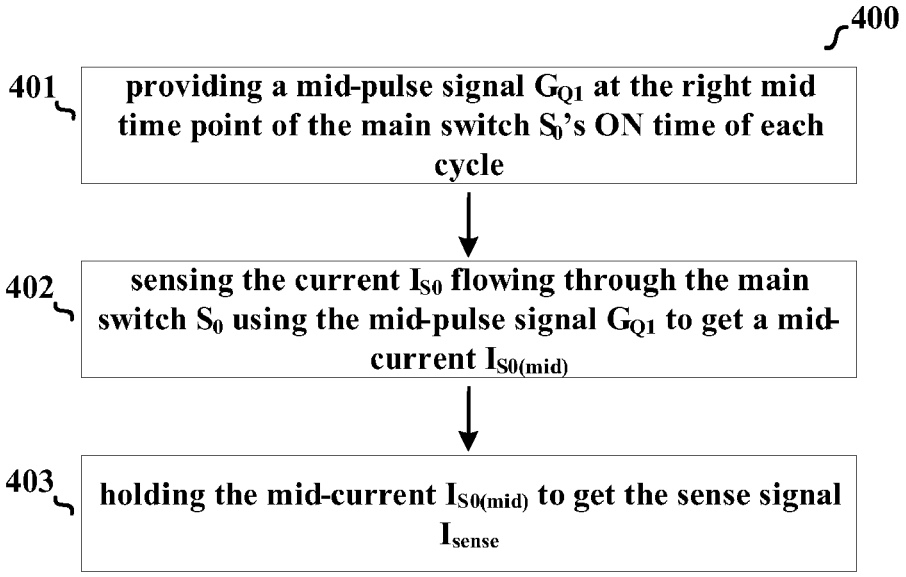
FIG. 15 illustrates a flowchart 400 of the mid-current sense in accordance with yet another embodiment of the present invention.

Referring to FIG. 15, a flowchart 400 of the mid-current sense is illustrated in accordance with yet another embodiment of the present invention. It comprises: step 401, providing a mid-pulse signal $G_{Q1}$ at the right mid time point of the main switch $S_0$'s ON time of each cycle; step 402, sensing the current $I_{S0}$ flowing through the main switch $S_0$ using the mid-pulse signal $G_{Q1}$ to get a mid-current $I_{S0(mid)}$; step 403, holding the mid-current $I_{S0(mid)}$ to get the sense signal $I_{sense}$.

Figure 16:
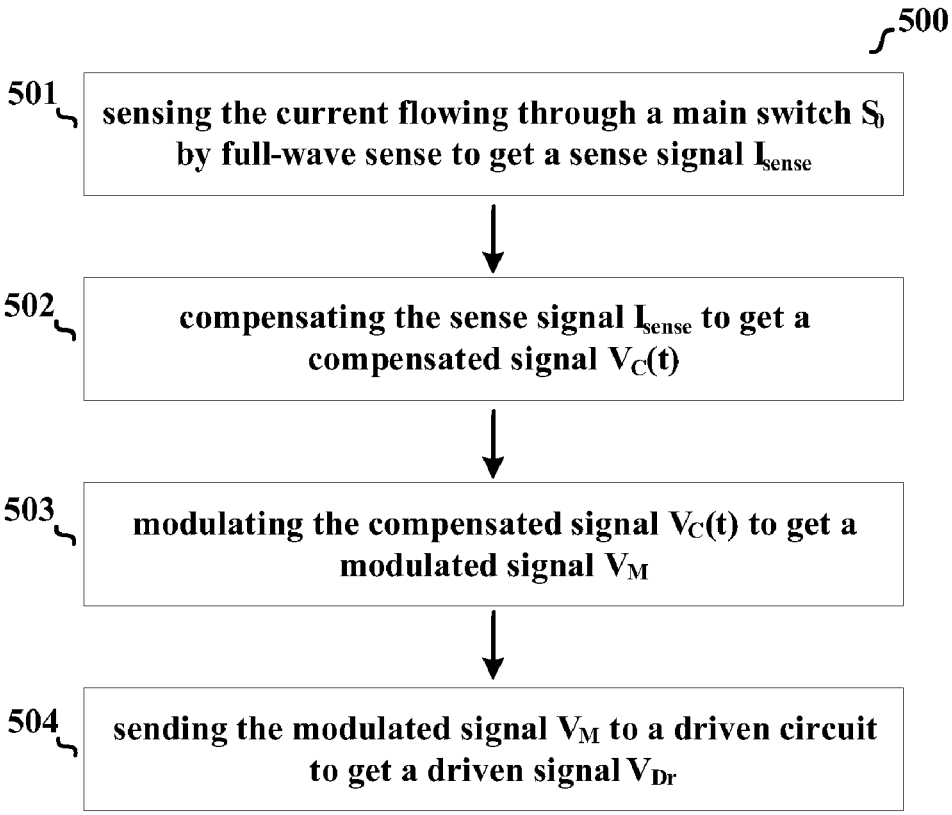
FIG. 16 illustrates a method 500 controlling the average current of the LED in accordance with yet another embodiment of the present invention.

Referring to FIG. 16, a method 500 controlling the average current of the LED accordance with yet another embodiment of the present invention is illustrated. The method 500 comprises: step 501, sensing the current flowing through a main switch $S_0$ by full-wave sense to get a sense signal $I_{sense}$; step 502, compensating the sense signal $I_{sense}$ to get a compensated signal $V_C(t)$; step 503, modulating the compensated signal $V_C(t)$ to get a modulated signal $V_M$; step 504, sending the modulated signal $V_M$ to a drive circuit to get a drive signal which is used to control the ON/OFF of the main switch $S_0$.

Figure 17:
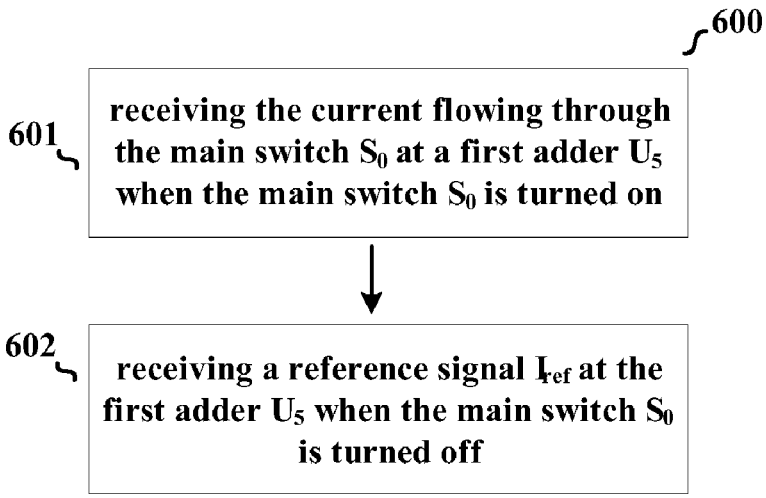
FIG. 17 illustrates a flowchart 600 of the full-wave sense in accordance with yet another embodiment of the present invention.

Referring to FIG. 17, a flowchart 600 of the full-wave sense is illustrated in accordance with yet another embodiment of the present invention. It comprises: step 601, receiving the current flowing through the main switch $S_0$ at a first adder $U_5$ when the main switch $S_0$ is turned on; step 602, receiving a reference signal $I_{ref}$ at the first adder $U_5$ when the main switch $S_0$ is turned off. The output signal provided by the first adder $U_5$ is the desired sense signal $I_{sense}$.

This written description uses examples to disclose the invention, including the best mode, and also to enable a person skilled in the art to make and use the invention. The patentable scope of the invention may include other examples that occur to those skilled in the art.

We claim:

1. A LED circuit, comprising:

a switch circuit which includes a main switch;

a sense unit, coupled to the switch circuit to sense and hold the current flowing through the main switch at the mid-point when the main switch is ON in each cycle, the sense unit operable to provide a sense signal;

a compensation unit, operable to provide a compensated signal in respond to the sense signal and a reference signal;

a modulate unit, operable to provide a modulated signal in respond to the compensated signal; and a drive circuit, operable to provide a drive signal in response to the modulated signal to drive the main switch in the switch circuit.

2. The LED circuit of claim 1, wherein the sense unit comprises a first switch and a hold circuit coupled in series.

3. The LED circuit of claim 2, wherein the sense unit further comprises:

a first delay circuit, operable to provide a first delay signal in respond to the drive signal;

a first inverter, coupled in series with the first delay circuit, operable to provide a delay-invert signal in respond to the first delay signal;

a second delay circuit, operable to provide a second delay signal in respond to the drive signal; and a AND gate, operable to provide a signal used to drive the first switch in respond to the delay-invert signal and the second delay signal.

4. The LED circuit of claim 1, wherein the modulation unit is a constant on-time modulation circuit.

5. The LED circuit of claim 1, wherein the compensation unit comprises:

an operation amplifier, operable to receive the sense signal and the reference signal, the operation amplifier operable to amplify the difference between the sense signal and the reference signal; and a RC filter, coupled between the output of the operation amplifier and ground.

6. A LED circuit, comprising:

a switch circuit which includes a main switch;

a sense unit, coupled to the switch circuit to sense the current flowing through the main switch, operable to provide a sense signal in respond to the sensed current and a reference signal;

a compensation unit, operable to provide a compensated signal in respond to the sense signal and the reference signal;

a modulate unit, operable to provide a modulated signal in respond to the compensated signal; and a drive circuit, operable to provide a drive signal in respond to the modulated signal to drive the main switch in the switch circuit.

7. The LED circuit of claim 6, wherein the sense unit comprises:

a second switch, operable to deliver the sensed current to a first adder when turned on, and disconnect the sensed current to the first adder when turned off;

a third switch, operable to deliver the reference signal to the first adder when turned on, and disconnect the reference signal to the adder when turned off; and the first adder, operable to provide the sense signal in respond to the sensed current and the reference signal.

8. The LED circuit of claim 7, wherein the second switch is controlled ON/OFF in-phase with the main switch, the third switch is controlled ON/OFF anti-phase with the main switch.

9. The LED circuit of claim 6, wherein the modulate unit is a constant on-time modulation circuit.

10. The LED circuit of claim 6, wherein the modulate unit is a PWM modulation circuit.

11. The LED circuit of claim 6, wherein the compensation unit comprises:

an operation amplifier, operable to receive the sense signal and the reference signal, the operation amplifier operable to amplify the difference between the sense signal and the reference signal; and a RC filter, coupled between the output of the operation amplifier and ground.

12. A method for controlling the average current of a LED, comprising:

(a) sensing the current flowing through a main switch in a switch circuit by mid-current sense to get a sense signal;

(b) compensating the sense signal to get a compensated signal;

(c) modulating the compensated signal by constant on-time regulation to get a modulated signal; and (d) sending the modulated signal to a drive circuit to get a drive signal which is used to control the ON/OFF of the main switch.

13. The method of claim 12, wherein (a) further comprises:

providing a mid-pulse signal at the right mid time point of the main switch's ON time of each cycle;

sensing the current flowing through the main switch using the mid-pulse signal to get a mid-current; and holding the mid-current to get the sense signal.

14. A method for controlling the average current of a LED, comprising:

(a) sensing the current flowing through a main switch by full-wave sense to get a sense signal;

(b) compensating the sense signal to get a compensated signal;

(c) modulating the compensated signal to get a modulated signal; and (d) sending the modulated signal to a drive circuit to get a drive signal which is used to control the ON/OFF of the main switch.

15. The method of claim 14, wherein step 1 further comprises:

receiving the current flowing through the main switch at a first adder when the main switch is turned on; and receiving a reference signal at the first adder when the main switch is turned off.

* * * * *